United States Patent [19]

Eke

[11] Patent Number: 4,508,947

[45] Date of Patent: Apr. 2, 1985

[54] MICROWAVE OVENS AND METHODS OF COOKING FOODS

[75] Inventor: Kenneth I. Eke, Sanderstead, England

[73] Assignee: Microwave Owens Limited, Surrey, England

[21] Appl. No.: 513,296

[22] Filed: Jul. 13, 1983

[30] Foreign Application Priority Data

| | | | |
|---|---|---|---|
| Jul. 17, 1982 | [GB] | United Kingdom | 8220786 |
| Oct. 20, 1982 | [GB] | United Kingdom | 8230015 |
| Nov. 19, 1982 | [GB] | United Kingdom | 8233098 |

[51] Int. Cl.[3] ..... H05B 6/06; H05B 6/78

[52] U.S. Cl. ..... 219/10.55 B; 219/10.55 F; 219/10.55 C; 219/10.55 R; 219/400; 126/21 A

[58] Field of Search ..... 219/10.55 B, 10.55 R, 219/10.55 E, 10.55 M, 10.55 F, 400, 10.55 C; 126/21 R, 21 A

[56] References Cited

U.S. PATENT DOCUMENTS

| | | | |
|---|---|---|---|
| 2,898,437 | 8/1959 | McFarland | 219/400 X |
| 4,196,330 | 4/1980 | Payne | 219/10.55 B |
| 4,308,444 | 12/1981 | Takagi et al. | 219/10.55 R X |
| 4,309,584 | 1/1982 | Terakami | 219/10.55 B |
| 4,332,992 | 6/1982 | Larsen et al. | 219/10.55 R |
| 4,337,384 | 6/1982 | Tanaka et al. | 219/10.55 R X |

FOREIGN PATENT DOCUMENTS

| | | | |
|---|---|---|---|
| 2048028 | 12/1980 | United Kingdom | 219/10.55 B |

*Primary Examiner*—Philip H. Leung
*Attorney, Agent, or Firm*—Penrose Lucas Albright

[57] ABSTRACT

A portable microwave oven is designed to be powered from a domestic power socket with a rating not exceeding 1800 watts for the U.S. market, or not exceeding 3000 watts for the U.K. market. The oven comprises a microwave generator for supplying microwave power to an oven cavity, a thermal heating element capable of heating the air within the oven cavity, a fan for forcing a recirculating flow of air over the heating element and in a continuous flow which within the oven cavity turns 180° over and around food on a turntable rotating in a direction opposite to the air flow which is then reheated and recycled, and a control circuit operative to supply continuous microwave power to the oven cavity selectively simultaneously with or separate from the supply of thermal power to the cavity. The microwave power heats the inside of the food and the thermal power dissipates the resulting moisture and browns the external surface of the food. Due to the circulation of heated air being concentrated away from the cavity's walls, they remain relatively cool and following completion of cooking food, cooler air is circulated in the cavity to reduce its temperature so it can be used again in a relatively cool state for the introduction of additional food to be cooked and commence the cooking process at approximately the same temperature following each use. Opening the oven door secures the power to the microwave heating but not that to the thermal heating element.

17 Claims, 5 Drawing Figures

MICROWAVE OVENS AND METHODS OF COOKING FOODS

DESCRIPTION

FIELD OF THE INVENTION

This invention relates to microwave ovens and to methods of cooking food.

BACKGROUND OF THE INVENTION

Microwave ovens are capable of cooking, defrosting and reheating food very rapidly but, because the heat energy is generated within the food itself by agitation of the food molecules, the exterior of the food does not reach the temperature required for browning. This disadvantage is met in known microwave ovens by providing some form of thermal heating means in addition to the microwave generator. For example, British Specifications Nos. 1172918 and 1332122 disclose ovens which have thermal heating elements in addition to microwave generators.

Known microwave ovens adopt different ways of using the two forms of energy, i.e. the microwave energy and thermal energy. One known oven produces thermal power only during a first cooking period followed by microwave power only during a second cooking period, the changeover from thermal power to microwave power occurring automatically. During the first period, the thermal power tends to crisp and brown food items without cooking them in the middle. During the second period when microwave energy only is supplied to the oven, steam is generated as a result of the middle of the food becoming heated, and this moisture must find its way out of the already crisp and brown outside of the food. The result is that the moisture tends to break down the outside of the food layer which absorbs the moisture and becomes soft and unappetizing. To disperse the moisture, the oven is vented during the second period and the temperature drops within the cavity causing deterioration in certain food products, particularly pastry items.

A second known microwave oven operates in the reverse sequence, by having a first cooking period during which microwave energy only is produced followed by a second period during which thermal energy only is produced. During the first period the oven cavity is vented by a forced flow of air to dissipate steam. On commencement of the second period, venting ceases and the thermal power is applied with the object of browning the food item.

Both of these known microwave ovens fail to deal with the problem of dissipating the moisture as it is produced during the period of production of microwave energy. Excess moisture causes condensation on cool oven surfaces as well as making the food soft and pappy. Too much venting to dissipate moisture reduces the temperature of the oven while the application of too much thermal energy tends to burn the outside of the food before the food is cooked in the middle.

The invention aims to provide a microwave oven and a method of cooking food in which the thermal heat input into the oven cavity is sufficient to cope with the moisture driven off the food as the latter is cooked by microwave energy. To achieve this, it has been found that continuous microwave power should be applied simultaneously with continuous thermal power.

Microwave ovens are known in which microwave power is applied simultaneously with thermal power. In general, however, such ovens have been large commercial or industrial ovens with high power ratings. This has meant that the power needed for the microwave generator and for the thermal heating elements for any cooking operation has hardly been limited by a power input level to the oven. By contrast, the invention is concerned with portable, plug-in appliances which are designed for domestic use and which can be plugged into a domestic socket having a specified power limit which differs from country to country. The present invention is concerned with providing an oven designed to operate with a maximum power input of 1800 watts (to suit the USA), and a oven designed to operate with a maximum power input of 3000 watts (to suit the UK).

It is known to provide microwave ovens with a fan which causes a flow of hot air (heated by thermal heating means) to pass over the food being cooked. Successful cooking of food in such microwave ovens depends on the correct choice of a number of factors, one of which is the pattern of air flow within the oven cavity. Once commercially available oven draws heated air into the cavity from the mid region of the back wall of the cavity, the air being drawn forwardly before splitting up into two streams which are turned to flow backwards along the sides of the oven cavity, before leaving the cavity at two locations in the back wall of the cavity. It has been found that this air flow pattern does not always satisfactorily dissipate moisture generated from the food as it is being cooked by the microwave power. This is a particular problem with pastry items which become soft and pappy if the moisture resulting from the cooking is not dissipated by the hot air stream.

SUMMARY OF THE INVENTION

According to one aspect of the invention a portable microwave oven designed to be powered from a domestic power socket with a rating not exceeding 1800 watts comprises a microwave generator for supplying microwave power to a cavity of the oven, a rotatable turntable on the base of the cavity, thermal heating means capable of heating the air within the oven cavity, and control means operative to supply continuous microwave power to the cavity simultaneously with the supply of thermal power to the cavity, whereby the microwave power heats the inside of the food and the thermal power dissipates the resulting moisture and browns the external surface of the food, the thermal heating means comprising an electrical heating element and fan means for recirculating air over the element and through the cavity, the fan means causing a forced flow of air, heated by the thermal heating means, to enter the cavity from one side thereof, to pass over the turntable and leave the cavity from the other side thereof.

Preferably, the oven cavity has a rear wall behind which is a compartment accommodating the electrical heating element, the rear wall having on said one side an aperture allowing hot air to be forced by the fan to enter the cavity over a substantial height thereof, and the rear wall having adjacent the bottom corner at the other side a fan constituting said fan means.

Preferably, the power rating of the oven does not exceed 1620 watts, which allows a margin for US power limits.

According to another aspect of the invention a portable microwave oven designed to be powered from a domestic power socket with a rating not exceeding 3000 watts comprises a microwave generator for supplying microwave power to a cavity of the oven, a rotatable turntable at the base of the cavity, thermal heating means capable of heating the air within the oven cavity, and control means operative to supply continuous microwave power to the oven cavity, simultaneously with the supply of thermal power to the cavity, whereby the microwave power heats the inside of the food and the thermal power dissipates the resulting moisture and browns the external surface of the food, the thermal heating means comprising an electrical heating element and fan means for recirculating air over the element and through the cavity, the fan means causing a forced flow of air, heated by the thermal heating means, to enter the cavity from one side thereof, to pass over the turntable and leave the cavity from the other side thereof.

Preferably the power rating of the oven of said another aspect does not exceed 2650 or 2700 watts, which allows a margin for UK power limits.

According to a further aspect of the invention a method of cooking food in a portable microwave oven designed to be powered from a domestic power socket with a rating either not exceeding 1800 watts, or not exceeding 3000 watts, comprises supplying continuous microwave power to a cavity of the oven accommodating the food and simultaneously supplying thermal power to the cavity, whereby the microwave power heats the inside of the food and the thermal power dissipates the resulting moisture and browns the external surface of the food, the thermal power being applied by a recirculating flow of air which is forced by a fan to pass over an electrical heating element, to enter the oven cavity from one side thereof, to pass over the food while the latter is rotated on a turntable and to leave the oven cavity from the other side thereof.

With the lower power oven limited to 1620 watts total input power for the US market, it was found that thermal power of 1250 watts and microwave into the cavity of 200 watts produced good results. Since a typical source of microwave power is about 50% efficient, or slightly better, a power input into the cavity of 200 watts requires a power input to the microwave source of about 360 watts. Preferably, the oven has a single convection or thermal element producing the thermal power, this being sufficient not to require preheating of the oven. The microwave source (i.e. the magnetron) may be selected to operate at a higher power to deliver more power into the cavity, an interlock ensuring that the magnetron is on low power setting (i.e. 200 watts into the cavity) whenever the thermal element is energized.

With the higher power oven limited to 2650 watts for the UK market, more power is available and there are less constraints. There may be low, medium and high power levels for the magnetron, e.g. corresponding to 200, 300 and 600 watts into the cavity, and the single thermal heating element may have a power rating of about 1450 watts. For each of the lower and higher ovens, cooking preferably commences from a cold oven.

BRIEF DESCRIPTION OF THE DRAWINGS

Two microwave ovens according to the invention will now be described, by way of example, with reference to the accompanying drawings, in which.

DESCRIPTION OF THE PREFERRED EMBODIMENTS

Figure 1:
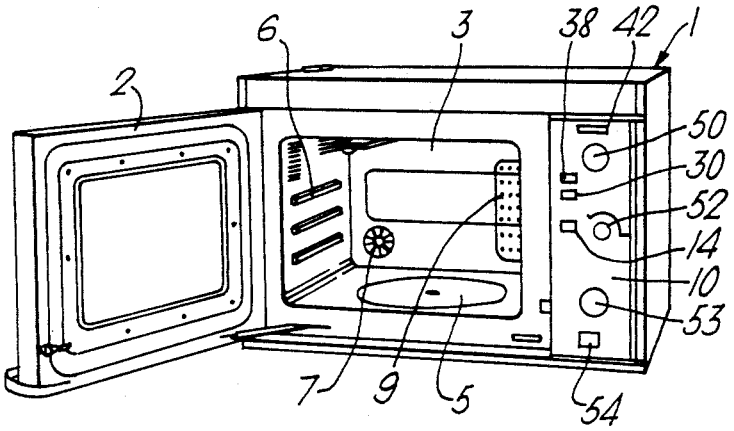
FIG. 1 is a perspective view of the first oven.
Figure 2:
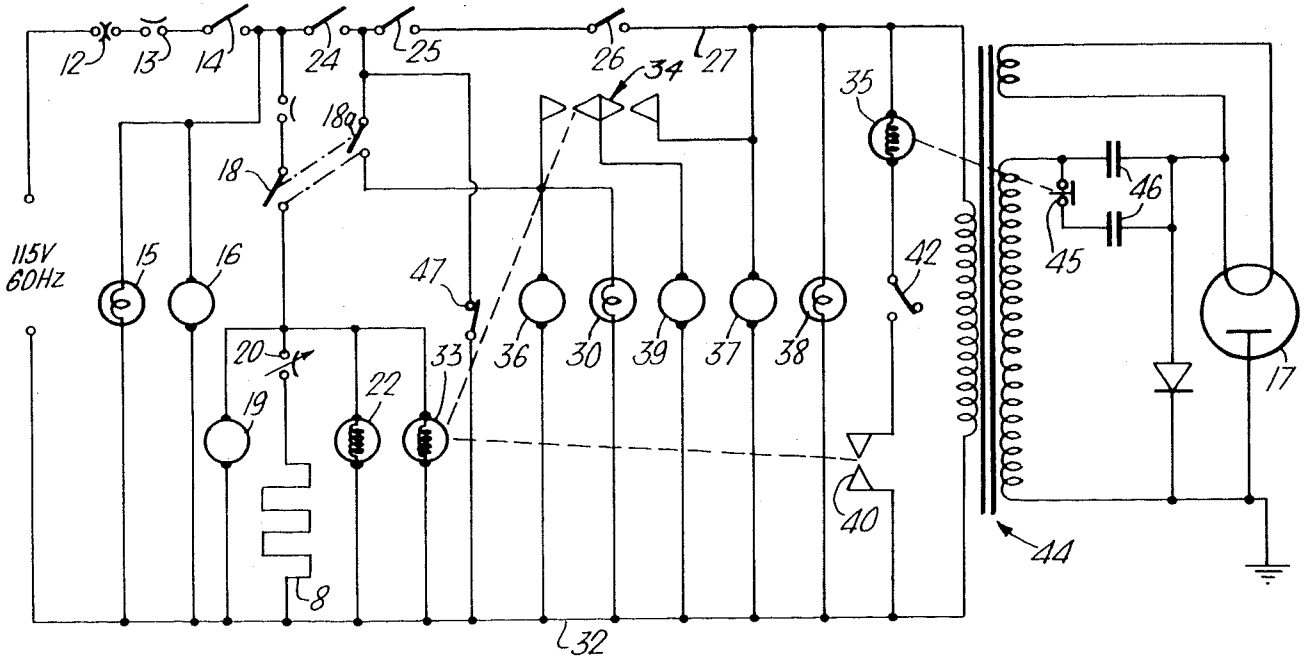
FIG. 2 is an electrical circuit diagram of the circuitry of the first oven.

FIGS. 1 and 2 show an oven designed for use in the USA where domestic appliances should not have a rating more that about 1650 watts. Referring to FIG. 1 the microwave oven has a casing 1 fitted with a hinged door 2 enclosing a cavity 3. The base is fitted with a turntable 5 for rotating the food during cooking. The sides of the cavity 3 have shelf guides 6 and the rear wall of the cavity 3 is provided with a fan 7 for circulating air over a convection element 8 (FIGS. 2 and 5) and through an apertured plate 9.

A control panel 10 has control knobs and dials for the cooker.

FIG. 2 shows the components of the electrical circuit of the oven. Power from 115 volt, sixty cycle electrical household circuit is led through a 15 amp fuse 12, a magnetron cut-out 13, and an on/off switch 14. When the switch 14 is closed, power at 115 v at 60 Hz is supplied to a cavity lamp 15 and a blower motor 16 for the cooker magnetron 17. A convection timer switch has ganged contacts 18, 18*a*. The contact 18 is connected to a motor 19 for the fan 7, a cavity thermostat 20 in series with the convection element 8 of about 1250 watts, a first relay coil 22, and a second relay coil 33.

A door switch 24, a microwave timer switch 25 and a cook start switch 26 are connected in series in the live power supply line 27 which leads power the magnetron 17 for supplying microwave power to the cavity. The contacts 18*a* and a convection timer motor 36 are connected across the live and neutral lines 27 and 32. A convection 'on' lamp 30 is connected in parallel across the timer motor 36. A microwave timer motor 37 and a microwave 'on' lamp 38 are connected across the live and neutral lines 27 and 32 in the position shown. A turntable motor 39 for the turntable 5 is connected across a central contact of relay contacts 34 and the neutral line 32. The relay coil 33 controls normally closed relay contacts 40 connected, together with a microwave power change switch 42 and a relay coil 35, across the live and neutral lines 27 and 32. A transformer 44 takes power into the magnetron 17. A switch 45 isolates one of two parallel-connected capacitors 46 so that the magnetron delivers low power. When the relay switch 45 is closed, both capacitors 46 are in circuit and the magnetron 17 delivers high power. On low power the magnetron delivers about 200 watts into the cavity 3, and on high power the magnetron delivers about 650 watts into the cavity 3. Since the magnetron is about 50% efficient, the power taken by the magnetron is about twice that delivered to the cavity, in each of the low and high power settings. For an output power into the cavity of 200 watts, the magnetron requires an input of about 360 watts.

Considering again FIG. 1, the control panel 10 has the following controls: the switch 42 for selecting high or low microwave power; a rotary timer 52 which controls the motor 37 and which therefore sets the time up to a maximum of sixty minutes for which the magnetron is operated; the microwave 'on' lamp 38; the convection 'on' lamp 30; the main switch 14; a rotary knob 52 which alters the setting of the thermostat 20 between 50° and 250° C.; a further rotary timer 53 which controls the motor 36 and therefore sets the time up to a maximum of 120 minutes for which the thermal power is produced; and a push-button 54 controlling the switch 26

The oven is used from a cold start in a 'mixed facility' mode, i.e. with thermal and microwave power, as follows:

(a) the microwave timer 50 is set for the desired cooking time;

(b) the knob 52 is rotated to set the temperature of the thermostat 20;

(c) the convection timer 53 is set for the desired cooking time;

(d) the door 2 is closed to close switch 24 and the cook button 54 is depressed to close the switch 26.

The turntable 5 will revolve and both timers driven by motors 36 and 37 will run simultaneously, causing microwave energy and thermal energy to be produced simultaneously.

So long as the relay coil 33 is energized (which occurs so long as the contact 18 is closed) the contacts 40 are open, which has the effect of ensuring that the magnetron produces low power, regardless of the position of the switch 42.

When the convection timer 53 reaches zero, the switch contacts 18, 18*a* open, which de-energises the convection heating element 8 and marks the end of the cooking period.

Also, the coils 22 and 33 are de-energized. De-energization of the coil 33 causes the contacts 34 to engage over. This ensures that the turntable motor can be energized either through the switches 25 and 26 or through the contact 18*a*. The lamp 38 will glow (preferably green) as long as microwave power is being produced, and the lamp 30 will glow (preferably orange) as long as thermal power is being produced. When the microwave timer 50 reaches zero, the switch 25 opens, thereby isolating the magnetron 17. When the oven door 2 is opened, switch 24 opens, thereby cutting off the supply of power to the magnetron. The usual short switch 47 is connected across the lines 27 and 32 to short out the magnetron 17.

The oven of FIGS. 1 and 2 may be operated in a microwave only mode or in a convection only mode, but best results have been achieved in the mixed facility mode described.

Figure 5:
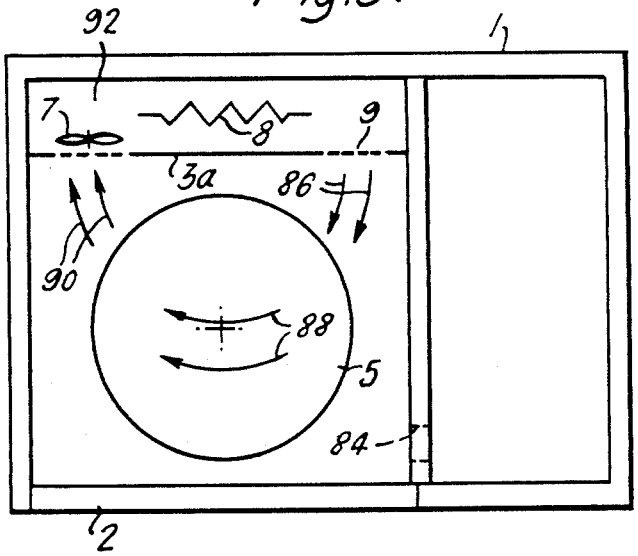
FIG. 5 is a diagrammatic plan view of either embodiment of oven, showing the flow pattern of hot air within the oven.

The relay coil 22 also operates a shutter (or flap) 84 for venting the oven cavity 3 under certain conditions. The shutter 84 is positioned near the top front corner of the right-hand side wall of the cavity 3, as shown in FIG. 5. When convection heat is being supplied to the cavity 3, the relay coil 22 is energized and this closes the shutter 84 to prevent the flow of air delivered by the blower motor 16 from reaching the cavity 3. When convection heat is not being supplied to the cavity 3, the coil 22 is de-energized, thereby opening the shutter 84 and allowing venting of the cavity. During venting, air delivered by the motor 16 is forced into the cavity and thence to atmosphere to remove moisture from the cavity.

Figure 3:
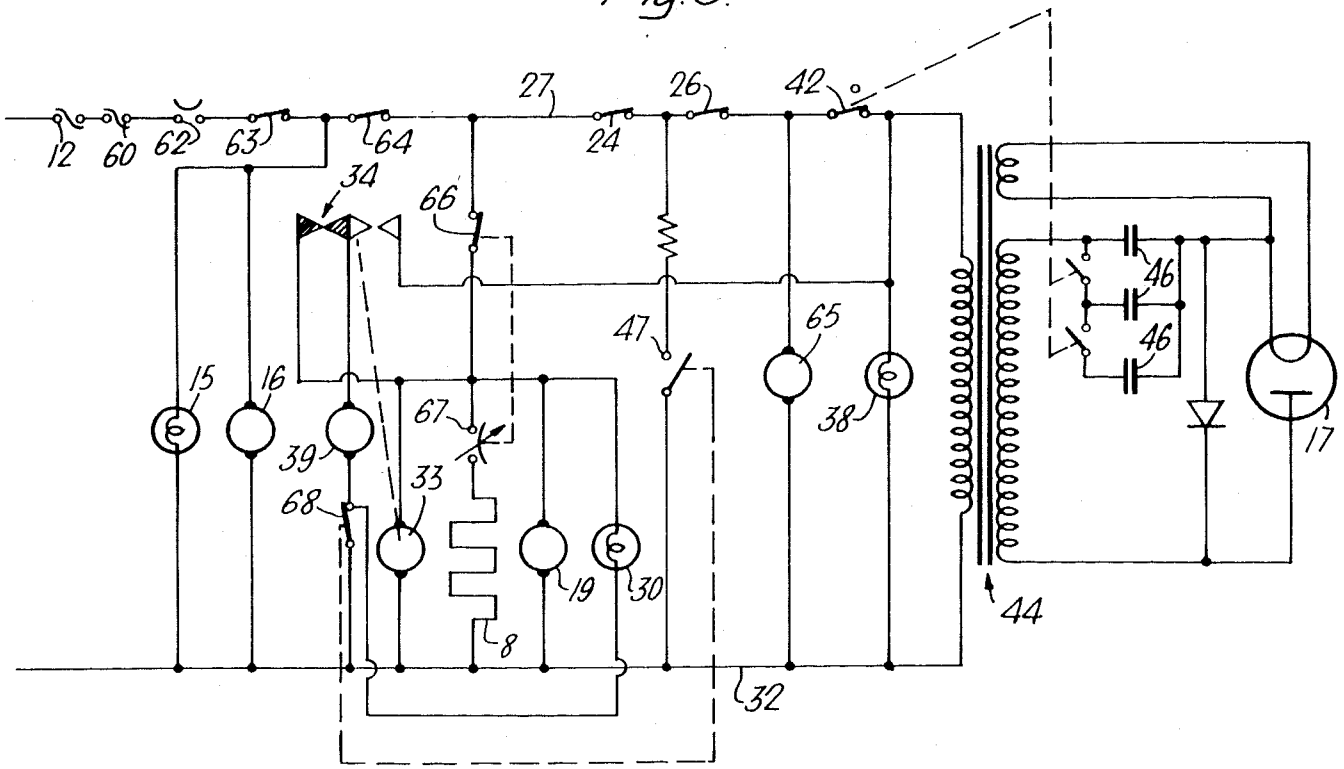
FIG. 3 is an electrical circuit diagram of the circuitry of the second oven.

The oven in FIG. 3 has been designed to suit the UK market, where power up to almost three kilowatts may be drawn from a domestic plug/socket.

In FIG. 3, parts corresponding to those of FIG. 2 have been given the same reference numerals. The microwave switch 42 has (in addition to an "off" position) low, medium and high power settings, bringing in one, two or three capacitors 46 respectively, and in any of the three settings the switch 42 closes to conduct power to the transformer 44.

In series with the fuse 12 (rated at 13 amps) is an oven thermostat 60 which cuts out if the cavity temperature rises too high. A magnetron thermostat 62 performs the same function for the magnetron 17. The two switches 63 and 64 are linked to one another, and the switch 64 is linked to a timer motor 65 in the following manner. The switch 63 is an on/off switch corresponding to the switch 14 of FIG. 2, and the switch 64 opens when the timer motor 65 reaches zero, the two switches 63 and 64 being controlled by a single rotary timer knob on the control panel 10.

A convection switch 66 enables the element 8 to be energized independently of the automatic timing facility afforded by the timer motor 65. Thus, in a manual mode, closure of the switch 66 will energize the element 8, causing thermal power to be produced without time limit and without microwave power. For an automatic or timed mode, the cook start switch 26 is closed, and the timer motor set to run from a preset time. When this time has elapsed the switch 64 will open, causing de-energization of the element 8.

When the microwave power is required, the switch 42 is set to the required microwave power level, the timer switch controlling the motor 65 is set to the desired time, and the switch 26 is closed. When the timer motor 65 reaches zero, the switch 64 will open, causing de-energization of the magnetron 17.

The switch 66 is linked to a thermostat switch 67 in the oven cavity, and the monitor switch 47 is mechanically linked to a turntable "off" switch 68.

As for the first embodiment, the oven is normally operated with thermal and microwave power being produced simultaneously, the end of the cooking period being marked by opening of the switch 64 which ceases the production of thermal and microwave power.

The relay coil 33 controls the contacts 34, as in the previous embodiment, and the coil 33 is also used to control the shutter 84. When the coil 33 is de-energized, air supplied by the blower 16 is directed into the cavity, but when the coil 33 is energized the shutter 84 closes an air entrance port to the cavity, directing the air to atmosphere.

The invention enables a microwave oven to operate very effectively on a maximum power intake suitable for US or UK requirements. The simultaneous delivery of thermal and microwave power enables the moisture to be dissipated by the thermal power as the moisture is produced from the inside of the food being cooked by microwave power. This has been found to be particularly advantageous for pastry items, which are particularly sensitive to any excess of moisture during cooking.

Figure 4:
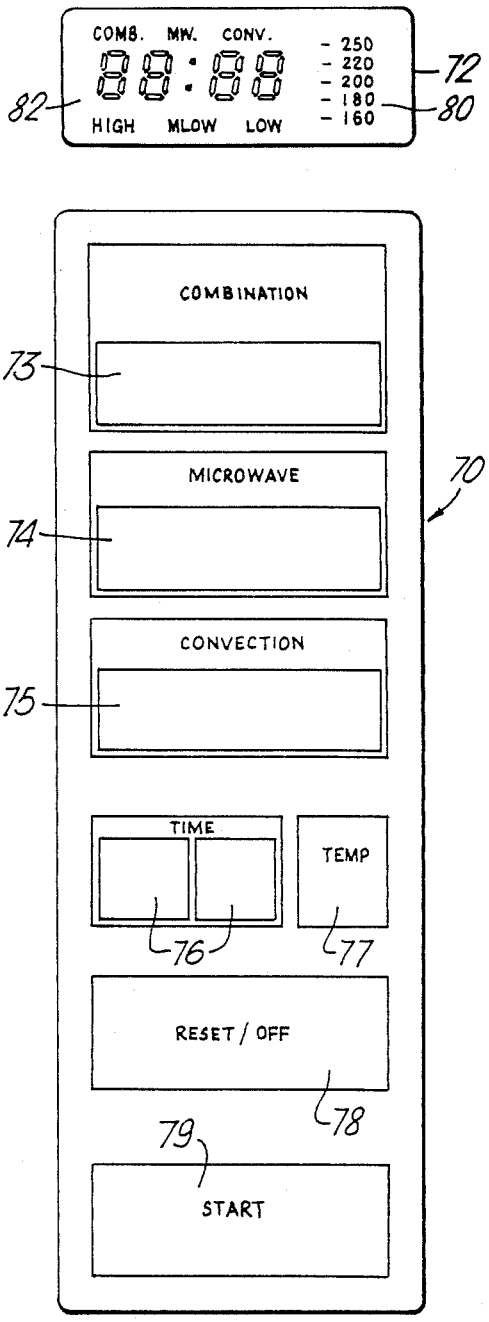
FIG. 4 shows an alternative control panel for the oven of FIGS. 2 and 3.

Instead of the described control panel 10, the oven of FIG. 2 or 3 may be equipped with the panel 70 shown in FIG. 4. The panel 70 has touch-sensitive pads, and a display 72. The pads comprise a COMBINATION pad 73, a MICROWAVE pad 74, a CONVECTION pad 75, two TIME pads 76, a TEMP pad 77, a RESET/-OFF pad 78 and a START pad 79. The panel 70 is operated as follows in three possible modes:

(1) Combination cooking mode (ie microwave and thermal power)

Touch COMBINATION pad 73—once for low microwave power twice for medium low microwave power (FIG. 3 only) three times for high microwave power (FIG. 3 only);

Touch TEMP pad 77 until desired temperature is reached, as indicated by FIGS. 80 illuminated in display 72;

Touch TIME pad(s) 76 until desired time is reached as indicated by FIGS. 82 in display 72;

Touch START pad 79.

During cooking, the display 72 shows the cooking time counting down, the temperature selected and the COMB mode. For the UK model of FIG. 3, it will also show which level of combination.

(2) Microwave only cooking mode

Touch MICROWAVE pad 74—once for high power twice for medium low three times for low power;

Touch TIME pad(s) 76 until desired time is reached;

Touch START pad 79.

During cooking, the display 72 shows the cooking time counting down, MW mode and microwave power level.

(3) Convection only cooking mode

Touch CONVECTION pad 75;

Touch TEMP pad 77 until desired temperature is reached;

Touch TIME pad(s) 76 until desired time is reached;

Touch START pad 79.

If preheat is required, the oven is set up as described and heated for a period of time or until the temperature is reached.

To indicate that the temperature is reached, the temperature indicator on the display could flash;

During cooking, the display 72 shows the cooking time counting down, the temperature selected and CONV mode.

At the end of the cooking time, a continuous bleep will sound and the heat will be automatically switched off.

To switch off bleep sound, touch pad 78 and time of day will be displayed. The pad 78 may alternatively be a depressible switch.

The pad 70 may be linked to a microprocessor providing the necessary control functions to the thermal heating elements, the microwave generator and other operative components of the oven.

The apertured plate 9 is positioned at the right-hand side of the rear wall 3*a* and is vertically elongated so as to allow hot air to enter the cavity 3 over a substantial height thereof. The fan 7 is positioned at the left-hand side of the rear wall 3*a*, near the lower corner, and is electrically driven to force a flow of hot air to pass over the food while the latter is supported on the rotary turntable 5.

FIG. 5 shows the air flow pattern within the oven. Hot air passing through the apertured plate 9 enters the cavity 3 (arrows 86), passes over the turntable 5 (arrows 88) and is drawn through the fan 7 (arrows 90) into a a compartment 92 at the rear of the cavity 3. Within the compartment 92 is arranged the thermal heating element 8 (shown diagrammatically in FIG. 5) which heats the air before the latter enters or re-enters the cavity 3. The turntable 5 rotates counter-clockwise as shown in FIG. 5 to maximize the relative velocity between the hot air entering the cavity through the aperture plate 9 and the food rotating on the turntable 5.

The described air flow pattern is efficient in heating the food, but leaves the walls of the oven cavity cool in comparison with known air flow patterns where hot air is blown alongside the cavity walls.

Above the fan 7, the rear wall 3*a* has vent holes (not shown) for venting of moisture to the oven surroundings.

It will be seen from the circuit diagrams of FIGS. 2 and 3 that if the door is opened during cooking, resulting in opening of the switch 24, the magnetron is de-energized but power continues to the heating element 8.

Having disclosed my invention, what I claim as new and to be secured by Letters Patent of the United States is:

1. A portable microwave oven designed to be powered from a domestic power socket with a rating not exceeding 1800 watts, comprising a microwave generator for supplying microwave power to a cavity of the oven, a rotatable turntable on the base of said cavity for supporting and rotating food therein, thermal heating means capable of heating the air within the oven cavity, and control means operative to supply continuous microwave power to said cavity simultaneously with the supply of thermal power to said cavity, whereby the microwave power heats the inside of the food rotated by said turntable and the thermal power dissipates the resulting moisture and browns the external surface of the food rotated by said turntable, said thermal heating means comprising an electrical heating element and fan means for recirculating air over said element and through said cavity, said fan means causing a forced flow of air, heated by said thermal heating means, to enter said cavity from one side thereof, to pass around and over food on said turntable in a direction opposite to its direction of rotation and thereafter to leave said cavity from the other side thereof.

2. A microwave oven according to claim 1, wherein said cavity has a rear wall behind which is a compartment accommodating said element, said rear wall having on said one side an aperture allowing hot air to be forced by said fan means to enter said cavity over a substantial height thereof, and said rear wall having adjacent the bottom corner at the other side, said fan means comprising a fan.

3. A microwave oven according to claim 1, wherein the power rating of the oven does not exceed 1620 watts, which allows a margin for US power limits.

4. A microwave oven according to claim 3, wherein said thermal heating means produces 1250 watts and said microwave generator produces 200 watts in said cavity.

5. A microwave oven according to claim 3, wherein said microwave generator is capable of operating at a high or low level, an interlock ensuring that said microwave generator is on the low power level whenever said electrical heating element is energized.

6. A portable microwave oven designed to be powered from a domestic power socket with a rating not exceeding 3000 watts comprising a microwave generator for supplying microwave power to a cavity of the oven, a rotatable turntable at the base of said cavity for supporting and rotating food therein, thermal heating means capable of heating the air within said cavity, and control means operative to supply continuous microwave power to said cavity, simultaneously with the supply of thermal power to said cavity so that said microwave power heats the inside of the food rotated by said turntable and said thermal power dissipates the resulting moisture and browns the external surface of the food, said thermal heating means comprising an electrical heating element and fan means for recirculating air over said element and through said cavity, said fan means causing a forced flow of air, heated by the thermal heating means which enters said cavity fom one side thereof, passes around and over the food on said turntable in a direction opposite to its direction of rotation and thereafter leaves said cavity from the other side thereof in a flow pattern which permits the walls of said cavity to remain relatively unheated.

7. A microwave oven according to claim 6, wherein the power rating of the oven does not exceed 2700 watts, 8. A microwave oven according to claim 7, wherein the microwave generator has low, medium and high power levels.

9. A microwave oven according to claim 8, wherein the low, medium and high power levels correspond to 200, 300 and 600 watts into the cavity.

10. A microwave oven according to claim 6, wherein the electrical heating element has a power rating of substantially 1450 watts.

11. A method of cooking food in a portable microwave oven, comprising supplying continuous microwave power to a cavity of the oven accommodating the food and simultaneously supplying thermal power to said cavity so that said microwave power heats the inside of the food and the thermal power dissipates the resulting moisture and browns the external surface of the food, said thermal power being applied to a recirculating flow of air which is forced by a fan to pass over an electrical heating element behind said cavity, to enter said cavity from one side at the rear thereof, to pass around and over the food in a single pass within said cavity while the food is rotated in an opposite direction to said air flow on a turntable and thereafter to leave said cavity from the other side at the rear thereof for being again heated by said element and returned to said cavity so that the air flow is continuously circulated in the same path around and over the food on said turntable after having been heated by said element.

12. A method of cooking food in accordance with claim 11, wherein said air flow pattern is minimal at the sides of said cavity so that the walls of said cavity remain relatively unheated.

13. A portable microwave oven designed to be powered from a domestic power socket with a rating not exceeding 1800 watts, comprising a microwave generator for supplying microwave power to a cavity of the oven, a blower motor for said microwave generator, a rotatable turntable on the base of said cavity for supporting and rotating food therein, a port in a wall of said cavity, a shutter movable between an open position in which air is blown through the port and into said cavity by the blower motor and a closed position in which said shutter prevents air delivered by said blower motor from reaching said cavity, thermal heating means capable of heating the air within said oven cavity, and control means operative to supply continuous microwave power to said cavity simultaneously with the supply of thermal power to said cavity, whereby the microwave power heats the inside of the food and the thermal power dissipates the resulting moisture and browns the external surface of the food, said thermal heating means comprising an electrical heating element and fan means for recirculating air over said element and through said cavity, said fan means causing a forced flow of air, heated by said electrical heating element, to enter said cavity from one side thereof, to pass around and over the food on said turntable in a direction opposite to its direction of rotation and thereafter leave said cavity from the other side thereof, said shutter being in the closed position when said electrical heating element is energized and in the open position to vent the cavity when said electrical heating element is de-energized.

14. A microwave oven according to claim 13 which includes timing means for maintaining the supply of electrical power to said microwave generator and said heating element for a pre-set cooking time, upon the expiration of which said microwave generator and said heating element are de-energized to terminate cooking and said shutter moves from the closed position to the open position to cause air to be blown into the cavity by said blower motor.

15. A portable microwave oven designed to be powered from a domestic power socket having a standard maximum power rating comprising a microwave generator for supplying microwave power to a cavity of the oven, a rotatable turntable on the base of said cavity for supporting and rotating food therein, a door for closing sid cavity, an electrical door switch operable in dependence upon the position of said door such that said switch interrupts the supply of electrical power to said microwave generator when the door is open, thermal heating means capable of heating the air within said cavity, and control means operative to supply continuous microwave power to said cavity simultaneously with the supply of thermal power to said cavity so that the microwave power heats the inside of the food and the thermal power dissipates the resulting moisture and browns the external surface of the food, said thermal heating means comprising an electrical heating element and fan means for recirculating air over said element and through said cavity, said fan means causing a forced flow of air heated by the electrical heating element to enter said cavity from one side thereof, to pass over said turntable and thereafter to leave said cavity from the other side thereof, said microwave generator being supplied electrical power through said switch whereas said electrical heating element is supplied electrical power independently of said switch, so that when said door is opened during operation of the oven supply of electrical power to said microwave generator is interrupted by the switch and the supply of electrical power to the heating element is maintained.

16. A microwave oven according to claim 15, wherein the direction of circulation of the forced flow of air is opposite to the direction of rotation of said turntable when the oven is viewed in plan.

17. A portable microwave oven designed to be powered from a domestic power socket with conventional wattage limitations comprising a microwave generator for supplying microwave power to a cavity of the oven, a rotatable turntable on the base of said cavity for supporting and rotating the food therein, thermal heating means capable of heating the air within said cavity, and control means operative to supply continuous microwave power to said cavity simultaneously with the supply of thermal power to said cavity in a manner that the microwave power heats the inside of the food and the thermal power dissipates the resulting moisture and browns the external surface of the food, said thermal heating means comprising an electrical heating element and fan means for recirculating air over said element and through said cavity, said fan means causing a forced flow of air heated by said element to enter the cavity from one side thereof, to pass around and over the food on said turntable in a direction opposite to its direction of rotation and thereafter to leave said cavity from the other side thereof, the oven having a control panel with a first touch pad for seleting simultaneous microwave and thermal power into said cavity, a second touch pad for selecting microwave power only to said cavity, a third touch pad for selecting thermal power only into said cavity, a fourth touch pad for setting cooking time, a fifth touch pad for setting maximum temperature, and a sixth touch pad for starting cooking, so that a user wishing to have simultaneous microwave and thermal power touches said first touch pad to select the combination mode, said fourth touch pad to set the cooking time, said fifth touch pad to select the maximum temperature and said sixth touch pad to commence cooking.

* * * * *